US009395693B2

(12) United States Patent
Ruffieux

(10) Patent No.: US 9,395,693 B2
(45) Date of Patent: Jul. 19, 2016

(54) TIMEPIECE WITH DATE DISPLAY

(71) Applicant: Etienne Ruffieux, Posat (CH)

(72) Inventor: Etienne Ruffieux, Posat (CH)

(73) Assignee: Parmigiani Fleurier SA (CH)

( * ) Notice: Subject to any disclaimer, the term of this patent is extended or adjusted under 35 U.S.C. 154(b) by 0 days.

(21) Appl. No.: 14/761,665

(22) PCT Filed: Dec. 27, 2013

(86) PCT No.: PCT/IB2013/002870

§ 371 (c)(1),
(2) Date: Jul. 17, 2015

(87) PCT Pub. No.: WO2014/111746

PCT Pub. Date: Jul. 24, 2014

(65) Prior Publication Data

US 2015/0355601 A1 Dec. 10, 2015

(30) Foreign Application Priority Data

Jan. 17, 2013 (CH) ..... 0201/13

(51) Int. Cl.

| | |
|---|---|
| ***G04B 19/247*** | (2006.01) |
| ***G04B 19/24*** | (2006.01) |
| ***G04C 17/00*** | (2006.01) |

(52) U.S. Cl.

CPC ..... *G04B 19/247* (2013.01); *G04B 19/24* (2013.01); *G04C 17/0058* (2013.01)

(58) Field of Classification Search

CPC .... G04B 19/24; G04B 19/243; G04B 19/247; G04C 17/0058

See application file for complete search history.

(56) References Cited

U.S. PATENT DOCUMENTS

| | | | | |
|---|---|---|---|---|
| 4,257,113 | A * | 3/1981 | Meister | G04C 17/0066 368/188 |
| 5,327,401 | A * | 7/1994 | Besson | G04B 19/247 368/28 |
| 2005/0088917 | A1* | 4/2005 | Dalloz | G04B 19/247 368/37 |
| 2005/0169109 | A1* | 8/2005 | Watanabe | G04C 17/0058 368/37 |
| 2006/0098535 | A1* | 5/2006 | Marki | G04B 11/008 368/37 |
| 2006/0285445 | A1 | 12/2006 | Burkhardt | |
| 2008/0170474 | A1* | 7/2008 | Behling | G04B 19/247 368/37 |

(Continued)

FOREIGN PATENT DOCUMENTS

| | | |
|---|---|---|
| CH | 6010 | 7/1893 |
| CH | 310559 | 10/1955 |
| CH | 316461 | 11/1956 |
| CH | 690869 | 2/2001 |
| CH | 694138 | 7/2004 |
| DE | 20103818 | 6/2001 |

(Continued)

*Primary Examiner* — Amy Cohen Johnson
*Assistant Examiner* — Matthew Powell
(74) *Attorney, Agent, or Firm* — Galbreath Law Offices, P.C.; John A. Galbreath

(57) ABSTRACT

Timepiece with date display comprises two supports (20, 30), each bearing a set of signs (40, 50) according to an annular arrangement, one bearing signs (50) 0 to 9 forming the date digits and the other bearing signs (40) 0 to 3 forming the decimals, the respective signs (40, 50) being juxtaposed in order to indicate the date (70). The signs (40, 50) are disposed in a non uniform manner, such that the angular deviation formed between the start of a sign (40, 50) and the start of the following sign (40, 50) varies from one sign to another. The timepiece further comprises a mechanism for driving said supports (20, 30) by uniform angular pitches of around 36° per day for the support (30) bearing the signs (50) forming the digits and of around 45° per five days for the support (20) bearing the signs (40) forming the decimals.

6 Claims, 3 Drawing Sheets

(56) References Cited

U.S. PATENT DOCUMENTS

| | | | | |
|---|---|---|---|---|
| 2013/0208574 | A1* | 8/2013 | Saito | G04B 19/202 368/221 |
| 2014/0301170 | A1* | 10/2014 | Tran | G04B 19/247 368/37 |

FOREIGN PATENT DOCUMENTS

| | | |
|---|---|---|
| EP | 0529191 | 3/1992 |
| EP | 1070996 | 1/2001 |
| EP | 1476789 | 8/2003 |
| FR | 1174343 | 3/1959 |

* cited by examiner

TIMEPIECE WITH DATE DISPLAY

The present invention relates to a timepiece with a date display.

It is already known in the prior art timepieces capable of indicating the date. Document EP0529191B1 describes a date indicator for a clock, the digit disc and decimal disc being arranged in parallel alongside each other in such a manner that the digit disc and the decimal disc overlap in an area of an indicating position, a two digit number able to be represented in the area of an indicating position by a decimal number and a digit number visible through one of the windows arranged on the decimal disc, said two digit number being visible in a date window of the watch face. The main drawback of this system is that the superposition of the two discs does not make it possible to always have a homogenous display in as far as a stationary position for a number sometimes leads to more or less important spaces between the decimal number and that of the digits according to the displayed numbers.

It is also known, document CH316461A which relates to a date device for a watch, comprising two rotating discs with jumping indicating digits, associated such that a digit of one of the discs and a digit of the other disc may form a two digit number indicating the day of the month and appear as juxtaposed, or partially juxtaposed, in an aperture of the dial, the digit disc being intermittently driven by the watch movement and in turn driving the decimal disc. Notches are made at the periphery of the upper disc to let the digits of the lower disc show. This system prevents having a homogenous display of the decimal number and the digit number when these are visible through an aperture.

Document EP 1476789 describes a date display device adapted to cooperate with an aperture of a watch, the aperture being arranged along the 12-h-6 h axis or in the vicinity of this axis. First and second discs are superposed, of identical and concentric dimensions. The first disc is divided by thirteen virtual radiuses into as many identical sectors and comprises in the vicinity of its periphery the numbers 1 to 9 located on nine virtual consecutive radiuses, the digits 1 and 2 on the left of two following virtual consecutive radiuses, and the numbers 30 and 31 whereof the digits are located on either side of the last two virtual radiuses. The second disc is divided by eleven virtual radiuses into as many identical sectors and comprises in the vicinity of its periphery the digits 0 to 9 located on the right of the ten virtual consecutive radiuses, the area of the eleventh virtual radius bearing no inscription. The display device comprises means arranged to drive the two discs such as to successively display the dates from 1 to 31 centered within the aperture. At least the upper disc is made of a transparent material, this disc being of glass, sapphire, or any other transparent material.

The display of the date by superposed or partially superposed discs is managed either by superposed discs that can be transparent, or by apertures on the upper disc.

The purpose of the present invention is to propose a timepiece with date display intended to homogenously indicate the numerals of digits and decimals through an aperture.

According to the invention, the timepiece with date display comprises two supports, for example superposed discs or rings, each bearing a set of signs according to an annular arrangement, one bearing signs from 0 to 9 forming the date digits and the other bearing signs from 0 to 3 forming the decimals, arranged in such a manner that the respective signs are juxtaposed in order to indicate the date, characterized by the fact that said signs are arranged in a non uniform manner, such that the angular deviation formed between the start of a sign and the start of the following sign varies from one sign to another, the signs 0 to 9 forming the digits being separated at an angle varying by around 33° between the signs 0 and 1 to around 38.5° between the signs 2 and 1, the signs 0 to 3 forming the decimals being doubled, (0, 0; 1, 1; 2, 2; 3, 3) and being separated at an angle varying by around 41° between the signs 1 and 0 to around 48° between the signs 2 and 1.

The timepiece further comprises a mechanism for driving said discs and/or rings by uniform angular pitches of around 36° per day for the disc/ring bearing the signs forming the digits and of around 45° per five days for the disc/ring bearing the signs forming the decimals.

The non uniform arrangement of the signs forming the digits on the lower disc or ring, associated with the non uniform arrangement of signs on the upper disc or ring forming the decimals makes it possible, via a uniform angular drive to obtain a uniform display of the date in the aperture.

The features of the invention will become more apparent upon reading the description of a preferential embodiment, given solely by way of example, which is in no way limiting and in reference to the schematic figures, in which.

Figure 1:
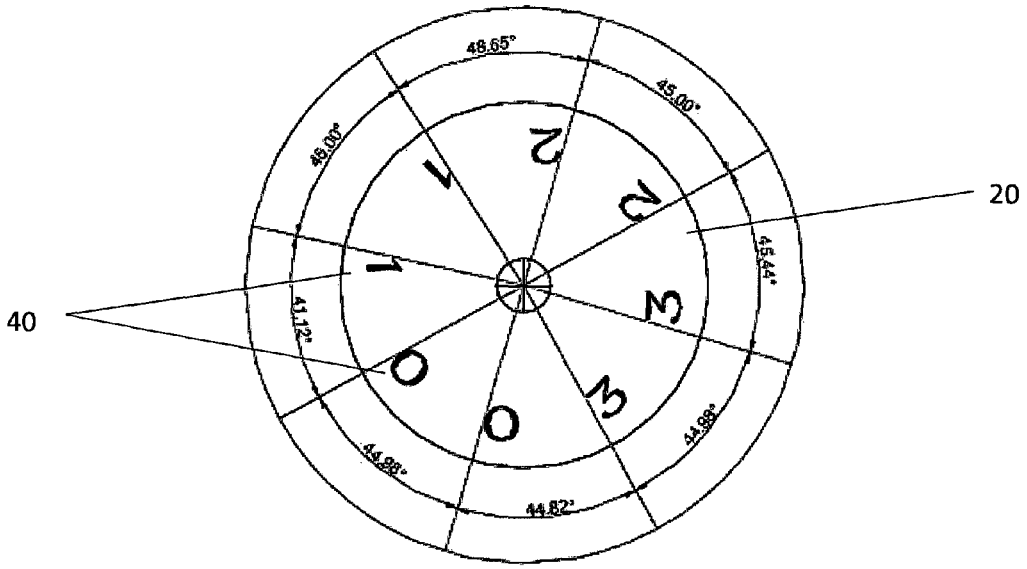
FIG. 1 represents a top view of a decimal disc according to the invention.

According to the preferential embodiment of the invention, the timepiece is a wrist-watch with a date display 70 comprising two superposed disks or rings 20, 30, one 30 bearing signs 50 from 0 to 9 forming the date 70 digits and the other 20 bearing signs 40 from 0 to 3 forming the date 70 decimals, arranged in such a manner that the respective signs 40, 50 are juxtaposed to indicate the date 70.

The signs 40, 50 are arranged in a non-uniform manner, in such a manner that the angular deviation formed between the start of a sign 40, 50 and the start of the following sign 40, 50 varies from one sign 40, 50 to another. The signs 50 from 0 to 9 forming the digits are separated at an angle varying by around 33° between the signs 0 and 1 to around 38.5° between the signs 2 and 1. The signs 40 from 0 to 3 forming the decimals are doubled, (0, 0; 1, 1; 2, 2; 3, 3) and are separated at an angle varying by around 41° between the signs 1 and 0 to around 48° between the signs 2 and 1.

The wrist-watch further comprises a mechanism for driving the discs and/or rings 20, 30 by uniform angular pitches of around 36° per day for the disc/ring 30 bearing signs 50 forming the digits and of around 45° per five days for the disc/ring 20 bearing signs 40 forming the decimals.

In order to have a uniform date 70 display, the signs 40, 50 of the dates can either be inscribed in a regular manner on each disc/ring 20, 30, which would imply an irregular jump of the discs/rings 20, 30 in such a manner that the jump be adapted to the sign 40, 50 to be displayed, or regular jumps can be kept and the non regular arrangement of the signs 40, 50 of the dates 70 on the discs/rings 20, 30 can be played with.

As illustrated in FIG. 1, the angular deviation between the identical signs 40 of the decimals (0, 0; 1, 1; 2, 2; 3, 3) is of 45°±0.1°. For example, the angular deviation between the sign 0 and the sign 0 is of 44.98° when the deviation between the sign 2 and the sign 2 is of 45°. The angular deviation between the non identical signs 40 of the decimals is of 45°±1° between the signs 0 and 3; of 45.5°±1° between the signs 3 and 2; of 48.5±1° between the signs 2 and 1; and of 41±1° between the signs 1 and 0.

Figure 2:
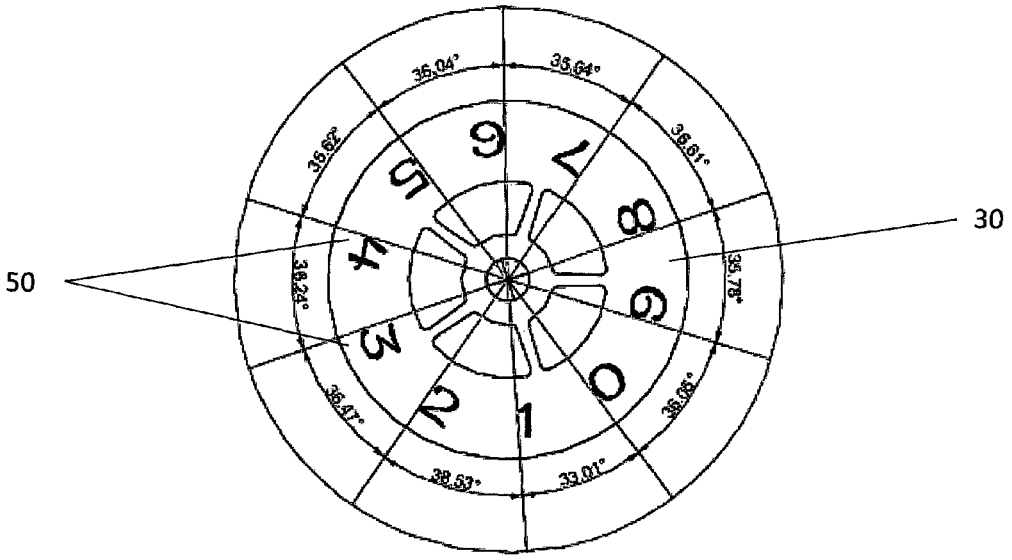
FIG. 2 represents a top view of a digit disc according to the invention.

As illustrated in FIG. 2, the angular deviation between the signs 50 from 0 to 9 forming the digits is: of 33°±1° between the signs 0 and 1; of 36°±1° between the signs 0 and 9; of 36°±1° between the signs 9 and 8; of 37°±1° between the signs 8 and 7; of 35.5°±1° between the signs 7 and 6; of 36°±1° between the signs 6 and 5; of 35.5°±1° between the signs 5 and 4; of 36°±1° between the signs 4 and 3; of 36.5°±1° between the signs 3 and 2; and of 38.5°±1° between the signs 2 and 1.

Figure 4:
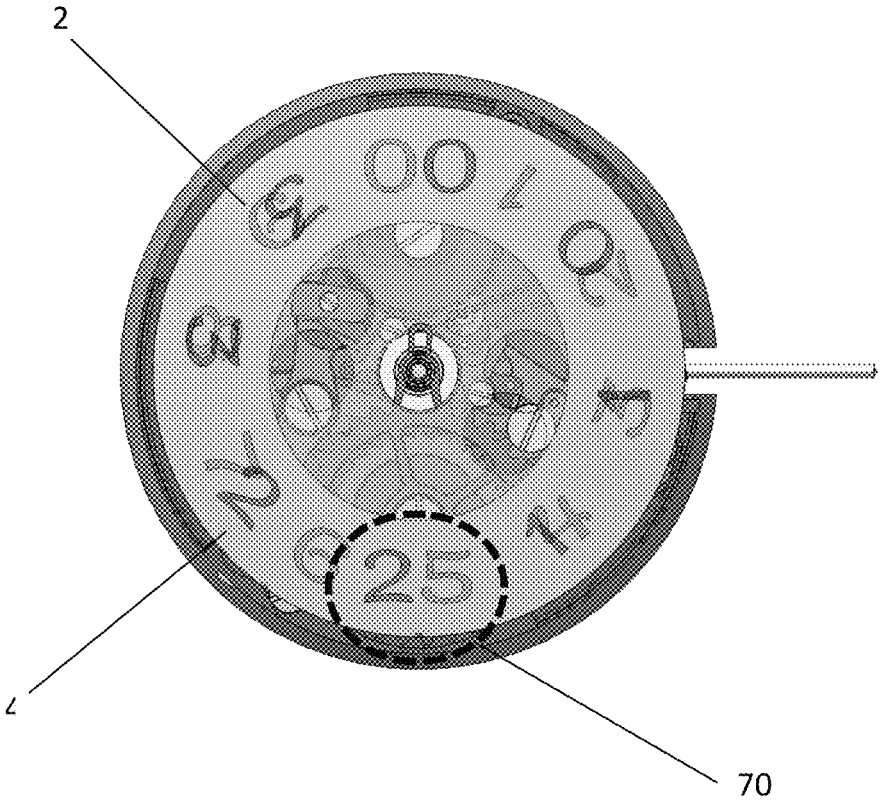
FIG. 4 represents a perspective view of a watch without its dial where is distinguished a decimal disc above a digit disc.
Figure 5:
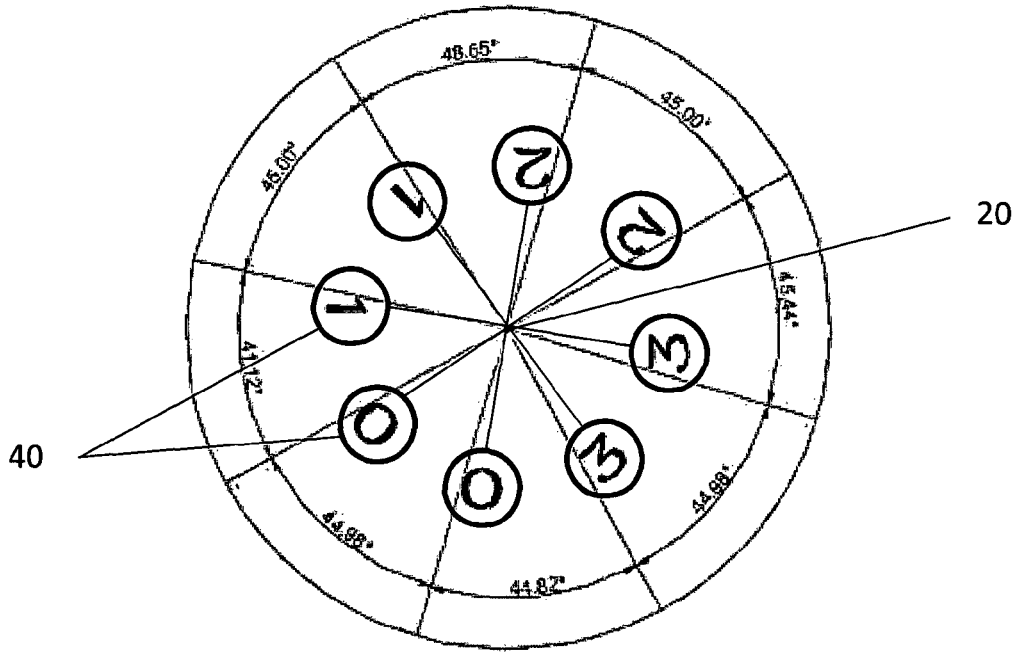
FIG. 5 represents a top view of a radial support of the decimals according to the invention.
Figure 6:
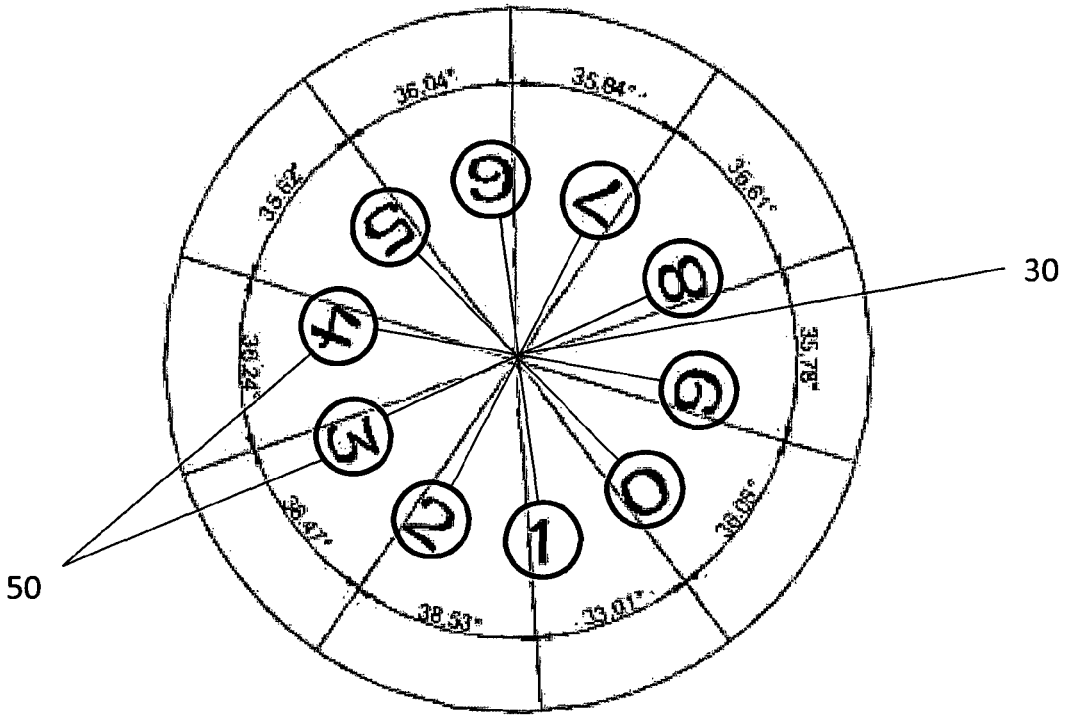
FIG. 6 represents a top view of a support of the digits according to the invention.

According to the preferential embodiment of the invention, at least one angular portion of the upper disc or ring 20, 30 which bears the signs 40, 50 is in a transparent matter. In fact, only the periphery of the upper disc or ring 20, 30 where the signs 40, 50 of the date 70 appear must be transparent. Hence, it may be used an entirely transparent disc or ring 20, 30 as illustrated in FIG. 4 where a watch without a dial can be seen, using discs or rings 20, 30 according to the invention, the upper disc or ring 20 being entirely transparent, letting the signs 50 of the lower disc 30 appear.

Alternatively, an upper disc 20, 30 in a non transparent material may comprise apertures allowing to see the signs 40, 50 of the lower disc 20, 30.

Figure 3:
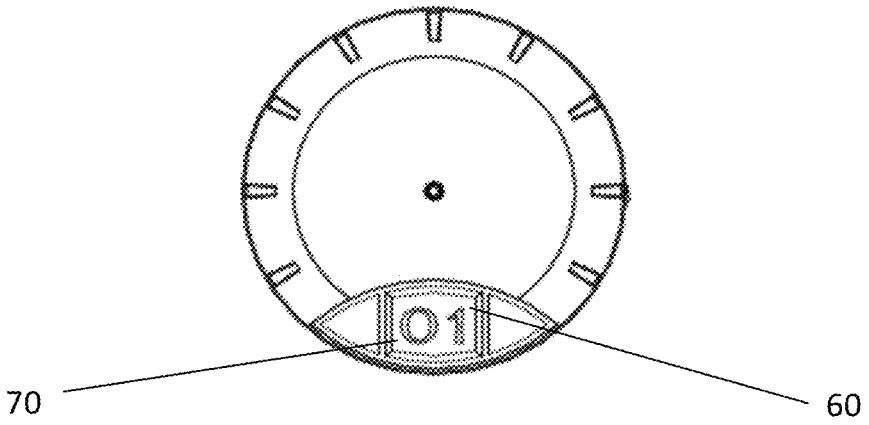
FIG. 3 represents a top view of the date display through a watch aperture.

As illustrated in FIG. 3, the non uniform arrangement of sigs 50 forming the digits on the lower disc or ring 30, associated with the non uniform arrangement of signs 40 on the upper disc or ring 20 forming the decimals makes it possible to obtain a uniform display of the date 70 in the aperture 60.

These angle measurements indicated in FIGS. 1, 2, 5 and 6 are given solely by way of example and correspond to a particular font.

The invention claimed is:

1. A timepiece with date display comprising two supports (20, 30), said supports comprising superposed discs or rings, each of the supports bearing a set of signs (40, 50) according to an annular arrangement, one support (30) bearing signs from 0 to 9 forming the date digits and the other support (20) bearing signs from 0 to 3 forming the decimals, arranged in such a manner that the respective signs (40, 50) are juxtaposed in order to indicate the date (70), characterized by the fact that said signs (40, 50) are disposed in a non uniform manner, such that the angular deviation formed between the start of a sign (40, 50) and the start of the following sign (40, 50) varies from one sign (40, 50) to another, the signs (50) 0 to 9 forming the digits being separated at an angle of 33°±1° between the signs 0 and 1 and an angle of 38.5°±1° between the signs 2 and 1, the signs (40) 0 to 3 forming the decimals being doubled, (0, 0; 1, 1; 2, 2; 3, 3) and being separated at an angle of 41°±1° between the signs 1 and 0 and an angle of 48.5°±1° between the signs 2 and 1, the timepiece further comprising a mechanism for driving said discs and/or rings (20, 30) by uniform angular pitches of around 36° per day for the disc/ring (30) bearing the signs (50) forming digits and of around 45° per five days for the disc/ring (20) bearing the signs (40) forming the decimals.

2. The timepiece according to claim 1, wherein the angular deviation between the identical signs (40) of the decimals (0, 0; 1, 1; 2, 2; 3, 3) is of 45°±0.1°.

3. The timepiece according to claim 2, wherein the angular deviation between the non identical signs (40) of the decimals is of 45°±1° between the signs 0 and 3; of 45.5°±1° between the signs 3 and 2; of 48.5±1° between the signs 2 and 1; and of 41±1° between the signs 1 and 0.

4. The timepiece according to claim 1, wherein the angular deviation between the signs (50) 0 to 9 forming the digits is: of 33°±1° between the signs 0 and 1; of 36°±1° between the signs 0 and 9; of 36°±1° between the signs 9 and 8; of 37°±1° between the signs 8 and 7; of 35.5°±1° between the signs 7 and 6; of 36°±1° between the signs 6 and 5; of 35.5°±1° between the signs 5 and 4; of 36°±1° between the signs 4 and 3; of 36.5°±1° between the signs 3 and 2; and of 38.5°±1° between the signs 2 and 1.

5. The timepiece according to claim 1, wherein at least one angular portion of an upper disc or ring (20, 30) which bears the signs (40, 50) is made of a transparent material.

6. The timepiece according to claim 1, which is a wristwatch.

* * * * *